US009337568B2

(12) United States Patent
Endo et al.

(10) Patent No.: US 9,337,568 B2
(45) Date of Patent: May 10, 2016

(54) WATERPROOF CONNECTOR

(71) Applicant: DAI-ICHI SEIKO CO., LTD., Kyoto (JP)

(72) Inventors: Takayoshi Endo, Shizuoka (JP); Seiji Sasaki, Shizuoka (JP)

(73) Assignee: DAI-ICHI SEIKO CO., LTD. (JP)

( * ) Notice: Subject to any disclaimer, the term of this patent is extended or adjusted under 35 U.S.C. 154(b) by 0 days.

(21) Appl. No.: 14/805,036

(22) Filed: Jul. 21, 2015

(65) Prior Publication Data

US 2016/0036157 A1 Feb. 4, 2016

(30) Foreign Application Priority Data

Jul. 31, 2014 (JP) ..... 2014-156763

(51) Int. Cl.

| | |
|---|---|
| ***H01R 13/40*** | (2006.01) |
| ***H01R 13/52*** | (2006.01) |
| ***H01R 13/436*** | (2006.01) |
| *H01R 13/506* | (2006.01) |
| *H01R 24/60* | (2011.01) |

(52) U.S. Cl.

CPC ..... *H01R 13/5202* (2013.01); *H01R 13/4365* (2013.01); *H01R 13/5219* (2013.01); *H01R 13/506* (2013.01); *H01R 24/60* (2013.01)

(58) Field of Classification Search

CPC ..... H01R 13/5202; H01R 13/4365; H01R 13/506; H01R 13/5219; H01R 13/60

USPC ..... 439/271, 587, 589

See application file for complete search history.

(56) References Cited

U.S. PATENT DOCUMENTS

| | | | | |
|---|---|---|---|---|
| 6,994,590 | B2 | 2/2006 | Nishida | 439/587 |
| 7,841,869 | B2 * | 11/2010 | Yamaguchi | H01R 13/521 439/589 |
| 8,337,245 | B1 * | 12/2012 | Wang | H01R 12/724 439/271 |
| 8,597,051 | B2 * | 12/2013 | Yang | H01R 12/57 439/589 |

FOREIGN PATENT DOCUMENTS

| | | |
|---|---|---|
| JP | 2002270275 | 9/2002 |
| JP | 2004185918 | 7/2004 |
| JP | 4986807 | 7/2012 |

* cited by examiner

*Primary Examiner* — Khiem Nguyen

(74) *Attorney, Agent, or Firm* — Hayes Soloway P.C.

(57) ABSTRACT

A waterproof connector includes a first housing formed with a recess, and a sealing unit to be sandwiched between the first housing and a second housing fit into the recess, to thereby keep waterproofness between the first and second housings, the sealing unit including a locking ring for engaging the sealing unit to the recess at a predetermined position, a holder for preventing a terminal having been inserted into the first housing from being released out of the first housing, and a waterproof seal sandwiched between an outer surface of the locking ring and an inner surface of the recess.

10 Claims, 15 Drawing Sheets

WATERPROOF CONNECTOR

BACKGROUND OF THE INVENTION

1. Field of the Invention

The invention relates to a waterproof connector configured to prevent water from penetrating an area in which terminals are housed.

2. Description of the Related Art

The waterproof connector 200 illustrated in FIGS. 13 to 19 is not disclosed in any publication, and not used in public. Accordingly, the waterproof connector 200 does not constitute prior art against the present invention. However, it is helpful for better understanding of the present invention to describe the waterproof connector 200. Thus, the waterproof connector 200 is explained hereinbelow with reference to FIGS. 13 to 19 only for the purpose of better understanding of the present invention. The description of the waterproof connector 200 does not mean that the applicant admits the waterproof connector 200 as prior art.

As illustrated in FIG. 13, the waterproof connector 200 includes a female housing 201 made of an electrically insulating material and formed with a recess 209 being open toward the front of the female housing 201, a front holder 202 fit into the recess 209, a front seal 203 fit into the recess 209, and a plurality of terminals 205 inserted into terminal storage spaces 204 being open at a rear of the female housing 201.

When a male housing 207 including a sealed circuit board 206 is inserted into the recess 209 of the female housing 201, an extension 206*a* of the sealed circuit board 206 is inserted into a space 208 formed in the female housing 201 and being open to the recess 209, and thereby, an electrically conductive portion formed at a surface of the extension 206*a* makes partial contact with one of the terminals 205 being exposed to the space 208. Thus, the sealed circuit board 206 and the terminal 205 are electrically connected to each other.

As illustrated in FIGS. 14 to 19, the waterproof connector 200 is designed to include an engagement piece 210 extending from a corner of the front holder 202, and a recess 211 being open to the front of the recess 209 in order to position the front holder 202 at a predetermined position in the recess 209 of the female housing 201. When the front holder 202 is fit into the recess 209, the engagement piece 210 of the front holder 202 is inserted into the recess 211, and thus, the front holder 202 is positioned at a predetermined position in the recess 209 in accordance with later-mentioned two steps.

Specifically, when the front holder 202 is fit into the recess 209 of the female housing 201 in a process of assembling the waterproof connector 200, the front holder 202 is subject to firstly a pre-set condition as illustrated in FIG. 17, and secondly a complete-set condition as illustrated in FIG. 19.

In order to carry out the above-mentioned two steps, as illustrated in FIG. 15, there are formed a first projection 213 and a second projection 214 in the recess 211. The engagement piece 210 is formed at a front end thereof with a projection 212 capable of being engaged with the first and second projections 213 and 214. The first and second projections 213 and 214 are spaced apart from each other in a direction Z (see FIG. 15 in which the first and second projections 213 and 124 downwardly protrude) in which the engagement piece 210 is inserted into the recess 211. The first projection 213 is located downstream relative to the second projection 214 in the direction Z. As illustrated in FIGS. 14 to 16 and 18, the first and second projections 213 and 214 are not aligned in the direction Z, but are aligned in a direction perpendicular to the direction Z.

In the pre-set condition illustrated in FIG. 17, the projection 212 of the engagement piece 210 is engaged with the first projection 213. In the complete-set condition illustrated in FIG. 19, the projection 212 is engaged with the second projection 214.

The waterproof connector 200 is accompanied with a structural limitation that the female connector 201 cannot be designed to include a through-hole through which inside and outside thereof make fluid-communication with each other, because an area in which an electrically conductive portion (not illustrated) of the extension 206*a* makes contact with the terminal 205 is necessary to be kept waterproof. Accordingly, the recess 211 formed in the female housing 201 has to have a bottom, as illustrated in FIG. 15. That is, a through-hole cannot be formed in place of the recess 211, and the recess 211 has to be dead-end in a direction Z in which the front holder 202 is inserted into the recess 211.

Consequently, in a die (not illustrated) used for molding the female housing 201 with resin, portions for molding the first and second projections 213 and 214 are undercut portions. As a solution to this problem, the first and second projections 213 and 214 were attempted to be formed by forced extraction from a die. However, the first and second projections 213 and 214 were shaved due to the friction generated between a die and themselves when the female housing 201 were separated from a die, resulting in that the projection 212 formed at the engagement piece 210 of the front holder 202 cannot have a sufficient margin with which the projection 212 is engaged with the first and second projections 213 and 214, and accordingly, it was difficult to put the front holder 202 into the above-mentioned pre-set condition.

Furthermore, the waterproof connector 100 is accompanied with a problem in that the waterproof connector 100 is assembled with a poor efficiency, because a plurality of parts such as the front holder 202 and the front seal 203 has to be attached to the female housing 201.

Japanese patent No. 4986807 has suggested a connector including a cover and a sealing unit. However, since the cover and the sealing unit are separate parts from each other, the connector is accompanied with a problem of a poor efficiency with which the connector is assembled.

Japanese Patent Application Publication No. 2004-185918 has suggested a waterproof connector, in which a terminal having been inserted into a housing is engaged only with a lance in the housing. The secondary engagement between the terminal and the housing is not prepared. Thus, the terminal cannot be fully held in a predetermined position, resulting in poor reliability to the connection between the terminal and the housing.

Furthermore, the waterproof connector does not have a function of detecting whether a terminal is completely inserted into a housing, resulting in poor reliability to the insertion of a terminal into a housing.

SUMMARY OF THE INVENTION

In view of the above-mentioned problems in the conventional connectors, it is an object of the present invention to provide a waterproof connector capable of fully fixing a front holder relative to a housing, being readily fabricated by a resin-molding process, reducing a number of parts to thereby enhance an efficiency with which the waterproof connector is assembled, and providing superior waterproof performance.

In one aspect of the present invention, there is provided a waterproof connector including a first housing formed with a recess, and a sealing unit to be sandwiched between the first housing and a second housing fit into the recess, to thereby keep waterproofness between the first and second housings, the sealing unit including a locking ring for causing the sealing unit to engage the recess at a predetermined position, a holder for preventing a terminal having been inserted into the first housing from being released out of the first housing, and a waterproof seal sandwiched between an outer surface of the locking ring and an inner surface of the recess, wherein the locking ring, the holder, and the waterproof seal are integrated with one another.

In the waterproof connector in accordance with the present invention, since the sealing unit can be engaged in the recess of the first housing at the predetermined position by means of the locking ring, the sealing unit is not necessary to include components indispensable for the waterproof connector, such as the engagement piece and the recess. Thus, the waterproof connector can be readily fabricated by a resin-molding process.

As mentioned above, the waterproof connector is accompanied with a structural limitation that the female connector cannot be designed to include a through-hole through which inside and outside thereof make fluid-communication with each other, because an area in which an electrically conductive portion (not illustrated) of the extension makes contact with the terminal is necessary to be kept waterproof. The waterproof connector in accordance with the present invention can be designed to include such a through-hole as mentioned above without the above-mentioned limitation.

The sealing unit in accordance with the present invention can be engaged in the recess of the first housing at the predetermined position by means of the locking ring, and hence, the sealing unit is not necessary to include components indispensable for the waterproof connector, such as the engagement piece having the projection, and the recess in which the first and second projections are formed. Thus, the sealing unit can be readily fabricated by a resin-molding process.

Furthermore, by designing the locking ring, the holder, and the waterproof seal to be integrated with one another, the number of parts for fabricating the sealing unit can be reduced, ensuring improvement in an efficiency with which the sealing unit is assembled.

In addition, the waterproof seal sandwiched between the outer surface of the locking ring and the inner surface of the recess provides sufficient waterproof performance.

It is preferable that the waterproof connector further include at least one projection projecting from the locking ring, and a plurality of recesses being open to an inner surface of the recess, the projection being fittable into the recesses.

It is preferable that the locking ring include a first side edge, and a second side edge spaced away from the first side edge and facing the first side edge, the sealing unit further including a first projection and a second projection, the first projection being formed on the first side edge, and outwardly extending from an outer surface of the locking ring in a direction perpendicularly to a length-wise direction of the sealing unit, the second projection being formed on the second side edge, and outwardly extending from an outer surface of the locking ring in a direction perpendicularly to a length-wise direction of the sealing unit, the first housing being formed with at least two first recesses or first through-holes into which the first projection is fit, and at least two second recesses or second through-holes into which the second projection is fit, the first recesses or first through-holes being spaced apart from each other in a direction in which the second housing is inserted into the recess, the second recesses or second through-holes being spaced apart from each other in a direction in which the second housing is inserted into the recess, a pitch between the first recesses or first through-holes being equal to a pitch between the second recesses or second through-holes.

It is preferable that the first projection and the second projection be situated in a diagonal line of the locking ring.

It is preferable that the locking ring further include a third projection standing on the first side edge and being spaced apart from the first projection, the third projection outwardly extending from an outer surface of the locking ring in a direction perpendicularly to a length-wise direction of the sealing unit, and a fourth projection standing on the second side edge and being spaced apart from the second projection, the fourth projection outwardly extending from an outer surface of the locking ring in a direction perpendicularly to a length-wise direction of the sealing unit.

It is preferable that the first and third projections be situated on the first side edge symmetrically about the center of the locking ring and the second and fourth projections are situated on the second side edge symmetrically about the center of the locking ring, one of a distance between the first and third projections and a distance between the second and fourth projections being greater than the other.

It is preferable that the first and second projections be situated closer to the front of the locking ring than the waterproof seal.

It is preferable that the holder include at least one extension insertable into a hole extending from the recess such that a posture of a lance engaged with the terminal having been inserted into the first housing is kept uniform.

It is preferable that each of the locking ring and the holder be a separate part, and the locking ring and the holder can be coupled to each other.

It is preferable that the locking ring include at least one extension horizontally extending from a front edge thereof, the extension being formed with a vertical through-hole, the holder including a projection to be fit into the vertical through-hole when the locking ring and the holder are coupled to each other.

The advantages obtained by the aforementioned present invention will be described hereinbelow.

The sealing unit can be engaged in the recess of the first housing at a predetermined position by means of the locking ring without including components indispensable for the waterproof connector, such as the engagement piece and the recess. Thus, the waterproof connector can be readily fabricated by a resin-molding process.

Furthermore, the number of parts for fabricating the sealing unit or the waterproof connector can be reduced, ensuring enhancement in an efficiency with which the sealing unit or the waterproof connector is assembled.

In addition, the waterproof seal sandwiched between the outer surface of the locking ring and the inner surface of the recess provides sufficient waterproof performance.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

First Embodiment

A waterproof connector 100 in accordance with a first embodiment of the present invention is explained hereinbelow with reference to FIGS. 1 to 12.

As illustrated in FIGS. 1 to 5, the waterproof connector 100 includes a female housing 10, and a sealing unit 50.

Figure 5:
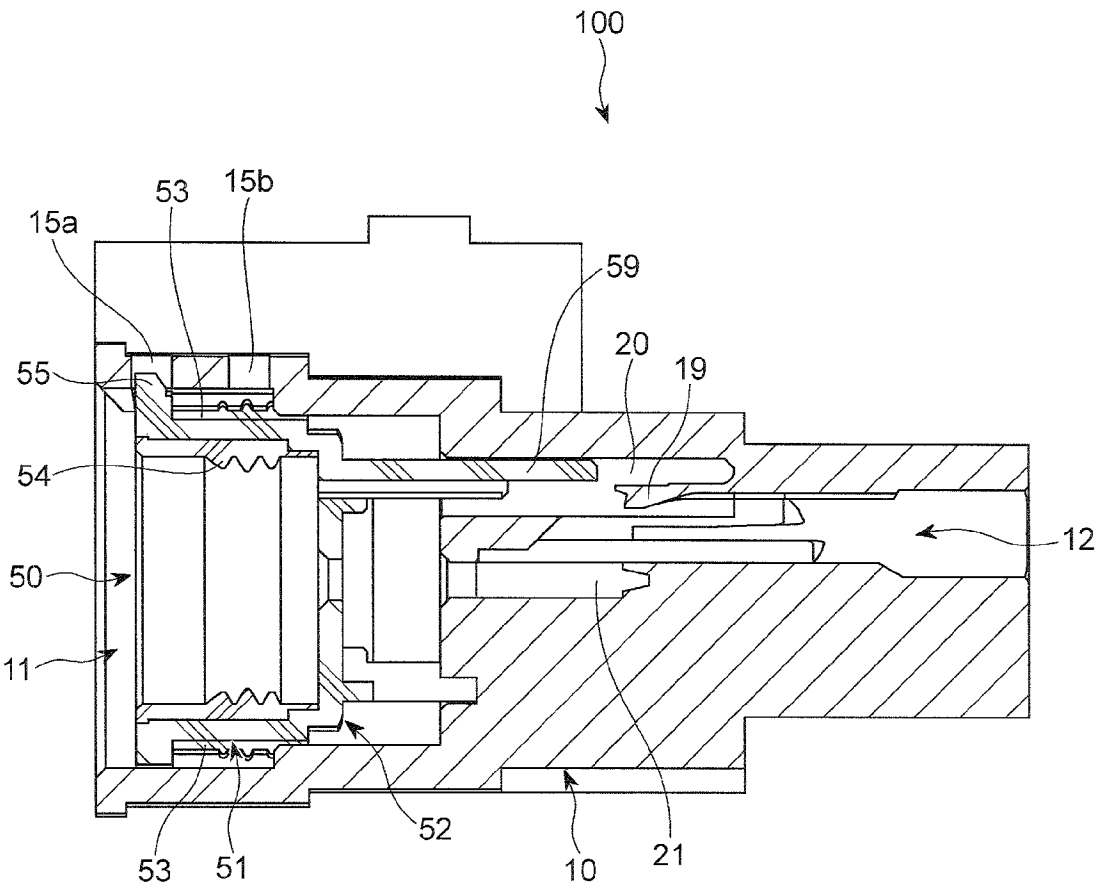
FIG. 5 is a cross-sectional view of the sealing unit and the female housing, wherein the sealing unit is fit into the female housing in a pre-set condition in a process of assembling the waterproof connector in accordance with the first embodiment of the present invention.

As best illustrated in FIG. 5, the female housing 10 is formed with a recess 11 being open to the front of the female housing 10, and having a bottom, and further with a plurality of terminal storage spaces 12 extending from a rear toward the front of the female housing 10, into which terminals 30 are inserted.

As mentioned later, the sealing unit 50 is sandwiched between the recess 11 and a later-mentioned male housing 70 inserted into the recess 11.

Herein, a wording "front" means an upstream of a direction indicated with an arrow F which is in parallel with a direction in which the terminals 30 are inserted into the terminal storage spaces 12, and a wording "rear" means an upstream of a direction indicated with an arrow R, that is, a direction in which the sealing unit 50 is inserted into the female housing 10.

The sealing unit 50 includes a locking ring 51 for causing the sealing unit 50 to engage the recess 11 at a predetermined position, a front holder 52 for preventing the terminals 30 having been inserted into the terminal storage spaces 12, from being released out of the terminal storage spaces 12, and a waterproof seal 53 sandwiched between an outer surface of the locking ring 51 and an inner surface of the recess 11.

The locking ring 51, the front holder 52, and the waterproof seal 53 are integrated with one another to thereby define the sealing unit 50.

The locking ring 51 includes at an inner surface thereof a second waterproof seal 54 to be sandwiched between an inner surface of the locking ring 51 and an outer surface of the male housing 70 inserted into the recess 11.

As later mentioned in detail, the waterproof connector 100 includes an engagement system by which the locking ring 51 can engage the sealing unit 50 to the female housing 10 at a plurality of positions spaced apart from one another in the direction R, that is, a direction in which the sealing unit 50 is inserted into the recess 11.

Figure 2:
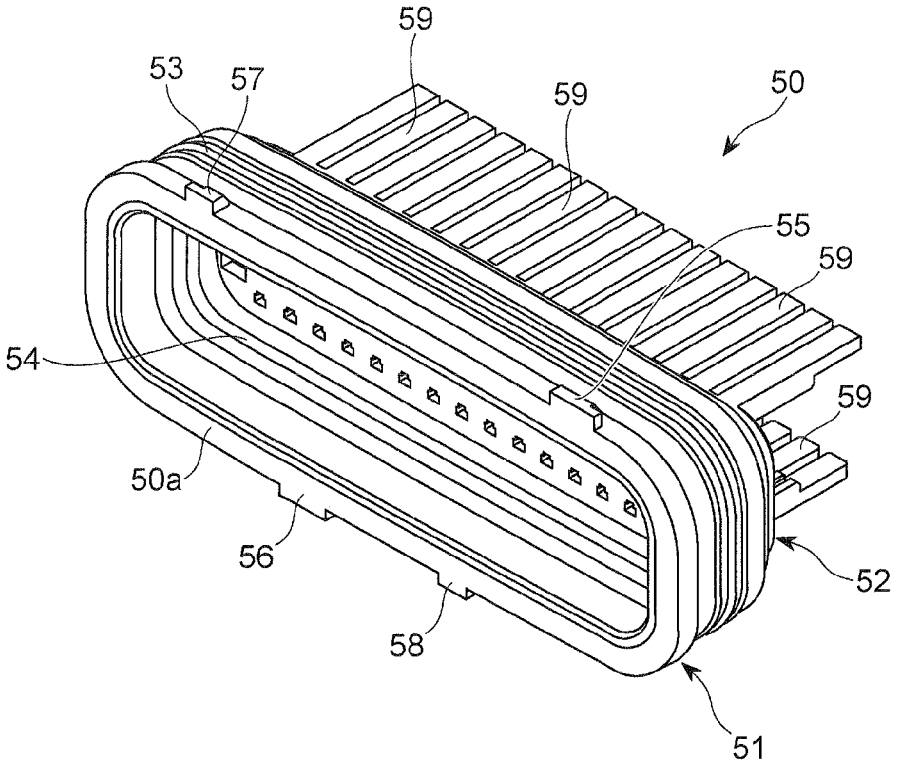
FIG. 2 is a perspective view of a sealing unit as a part of the waterproof connector illustrated in FIG. 1.
Figure 3:
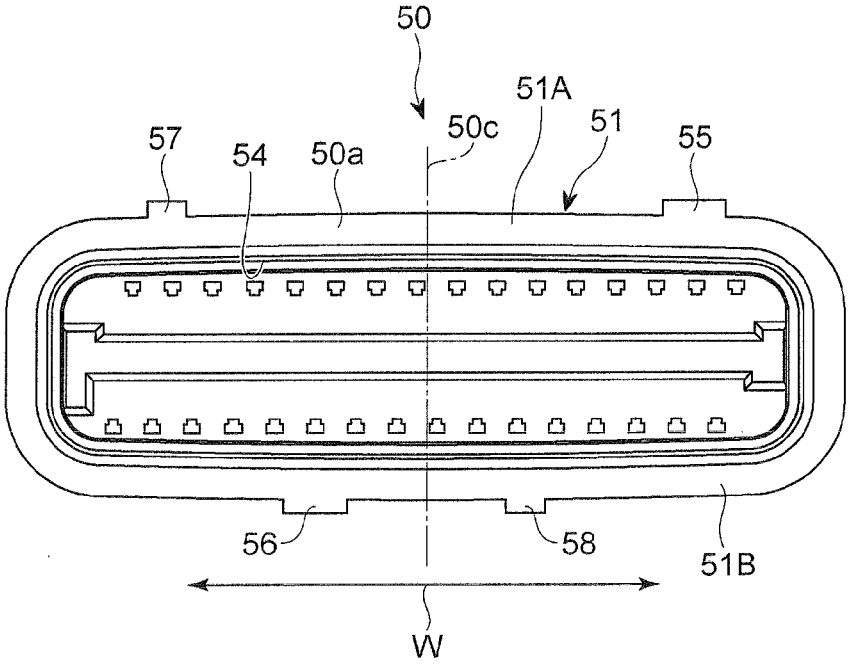
FIG. 3 is a front view of the sealing unit illustrated in FIG. 2.

As illustrated in FIGS. 2 and 3, the locking ring 51 has a rectangular cross-section 50*a* with rounded corners. The locking ring 51 has a first side edge 51A, and a second side edge 51B spaced away from the first side edge 51A and facing in parallel with the first side edge 51A.

The above-mentioned engagement system enabling the sealing unit 50 to be engaged in the recess 11 at a plurality of determined positions includes a first projection 55 standing on the first side edge 51A of the locking ring 51 and outwardly extending therefrom, a second projection 56 standing on the second side edge 51B of the locking ring 51 and outwardly extending therefrom, two first recesses 15*a* and 15*b* (see FIGS. 1 and 4) formed at an inner surface of an upper wall of the female housing 10, into which the first projection 55 can be fit, and two second recesses 16*a* and 16*b* (see FIG. 1) formed at an inner surface of a lower wall of the female housing 10, into which the second projection 56 can be fit.

The first recesses 15*a* and 15*b* are spaced apart from each other in the direction R, that is, a direction in which the sealing unit 50 is inserted into the recess 11. Similarly to the first recesses 15*a* and 15*b*, the second recesses 16*a* and 16*b* are spaced apart from each other in the direction R. A pitch between the first recesses 15*a* and 15*b* is equal to a pitch between the second recesses 16 and 16*b*.

As illustrated in FIGS. 2 and 3, the first projection 55 and the second projection 56 are situated in a diagonal line of the locking ring 51.

As illustrated in FIGS. 2 and 3, the locking ring 51 further includes a third projection 57 standing on the first side edge 51A and being spaced apart from the first projection 55, and a fourth projection 58 standing on the second side edge 51B and being spaced apart from the second projection 56.

The first and third projections 55 and 57 both standing on the first side edge 51A are situated symmetrically about the center line 50*c* in a width-wise direction W of the locking ring 51, and the second and fourth projections 56 and 58 both standing on the second side edge 51B are situated symmetrically about the center line 50*c* in the width-wise direction W of the locking ring 51. A distance between the first and third projections 55 and 57 is greater than a distance between the second and fourth projections 56 and 58.

Figure 1:
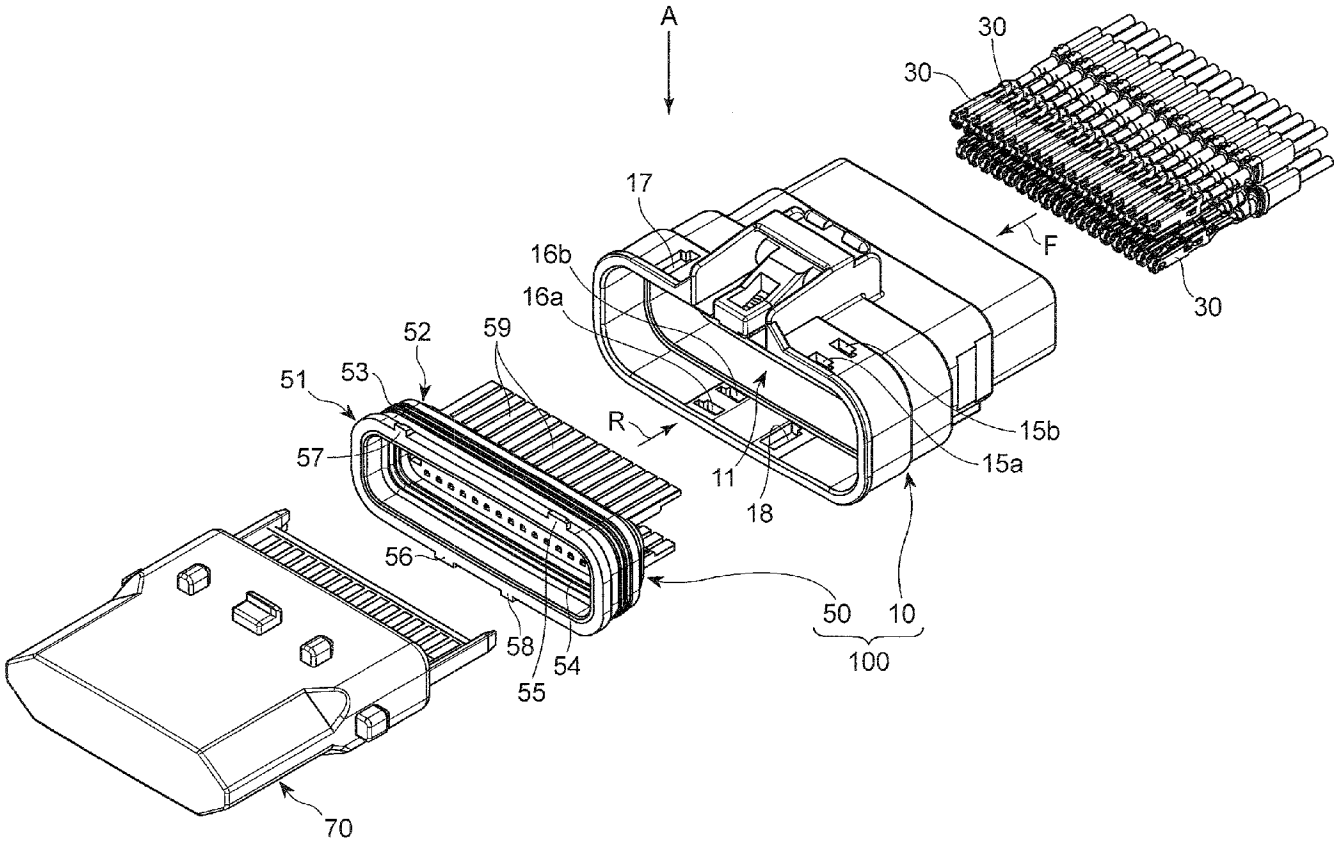
FIG. 1 is a broken perspective view of a waterproof connector in accordance with a first embodiment of the present invention.

As illustrated in FIG. 1, the female housing 10 includes, at an inner surface of an upper wall in the recess 11, a third recess 17 into which the third projection 57 is fit, and further, at an inner surface of a lower wall in the recess, a fourth recess 18 into which the fourth projection 58 is fit.

Figure 4:
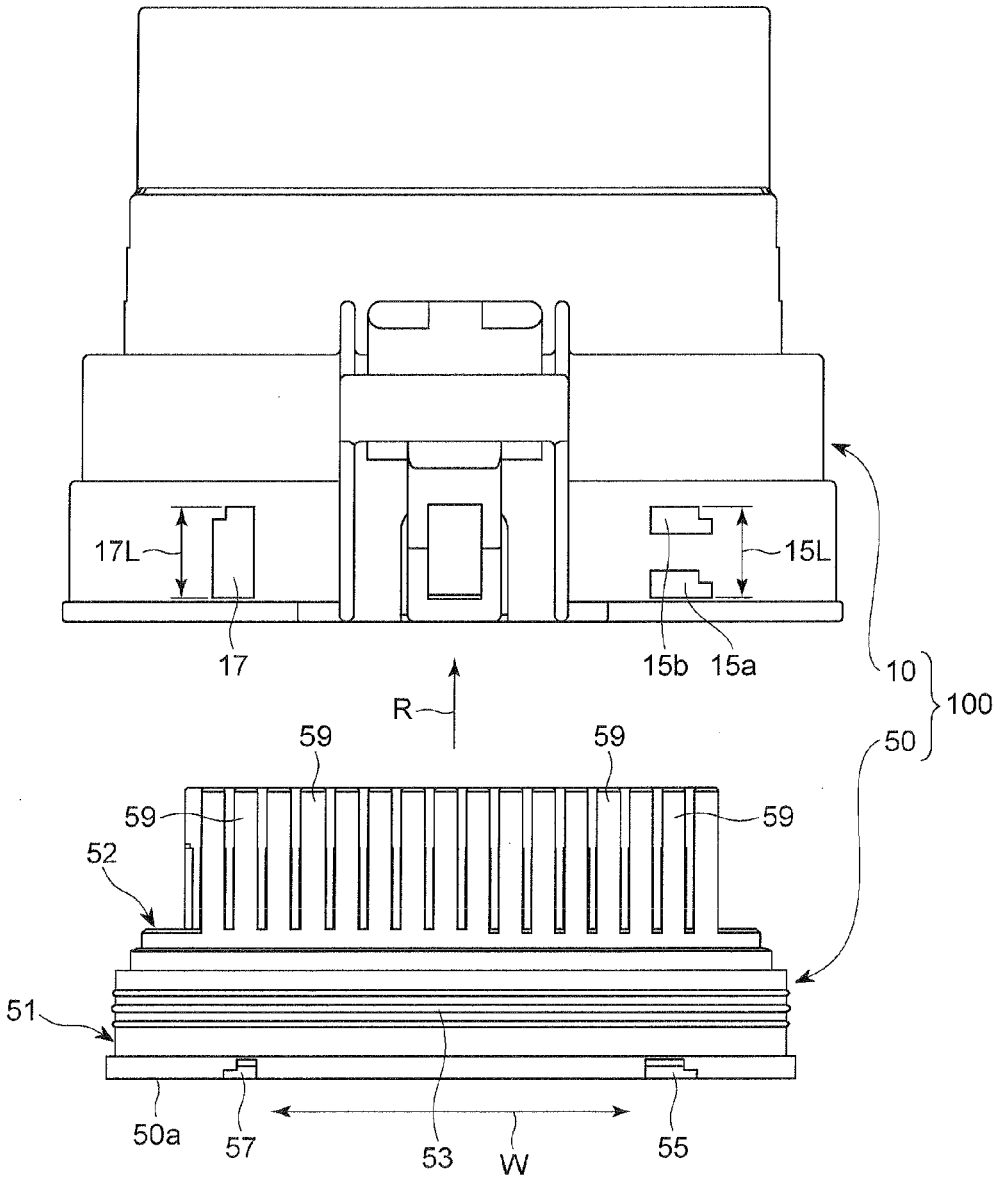
FIG. 4 is a plan view of the sealing unit and a female housing as viewed in a direction indicated with an arrow A shown in FIG. 1.

As illustrated in FIG. 4, the third recess 17 has a length 17L equal to a space 15L between outer edges of the first recesses 15*a* and 15*b* in the direction R. Though not illustrated, the fourth recess 18L has a length equal to a space between outer edges of the second recesses 16*a* and 16*b* in the direction R.

The first to fourth projections 55 to 58 are situated closer to the front of the locking ring 51 than the waterproof seal 53. Thus, even if the first recesses 15*a* and 15*b*, the second recesses 16*a* and 16*b*, the third recess 17, and the fourth recess 18 into which the first to fourth projections 55 to 58 are fit, respectively, were replaced with through-holes, it is possible to keep waterproofness between the sealing unit 50 and the female housing 10.

Furthermore, since the first to fourth projections 55 to 58, the first recesses 15*a* and 15*b*, the second recesses 16*a* and 16*b*, the third recess 17, and the fourth recess 18 are arranged outside of an area in which the waterproof connector 100 is electrically connected to a second electric connector, and accordingly, which is necessary to be kept waterproof, it is possible to form a through-hole, for instance, through which inside and outside of the waterproof connector 100 are in a condition of fluid-communication.

Figure 6:
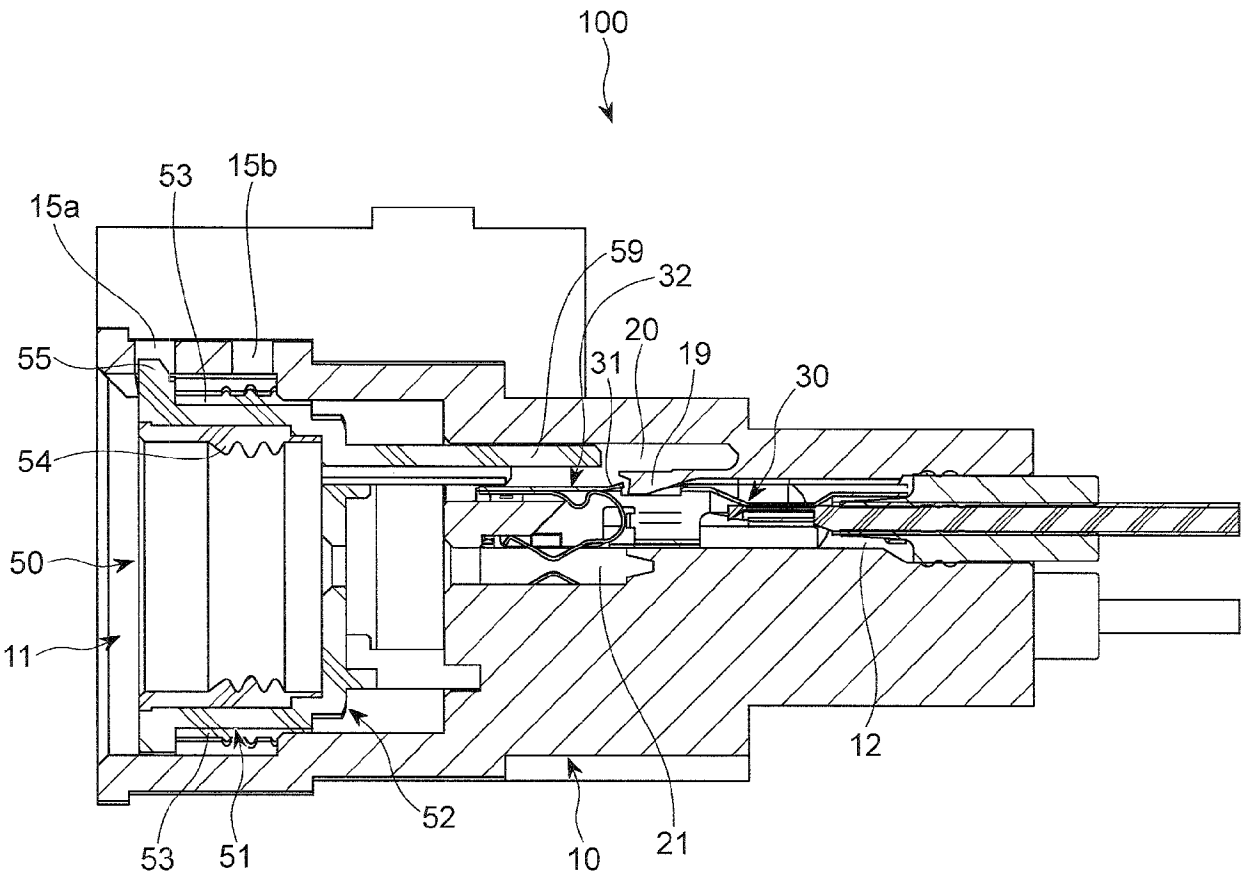
FIG. 6 a cross-sectional view of the sealing unit, the female housing, and a terminal, wherein the terminal is inserted into the female housing in a first engagement condition in a process of assembling the waterproof connector in accordance with the first embodiment of the present invention.

As illustrated in FIGS. 5 and 6, a lance 19 is formed in each of the terminal storage spaces 12 of the female housing 10. The lance 19 is engaged to a lance engagement portion 31 of the terminal 30 having been inserted into the terminal storage space 12. The lance 19 is designed to be able to elastically move forward to and retreat from the terminal storage space 12. The female housing 10 is formed with a plurality of holes 20 each extending from the recess 11 toward a rear of the female housing 10, and each being situated adjacent to each of the terminal storage spaces 12. In order to keep the lance 19 in a constant posture, the front holder 52 is formed at a rear thereof with a plurality of extensions 59 each being able to be inserted into each of the holes 20.

Hereinbelow is explained a process of assembling the waterproof connector 100, with reference to FIGS. 5 to 9.

First, as illustrated in FIG. 5, when the sealing unit 50 is inserted into the recess 11 of the female housing 10, the extensions 59 of the front holder 52 are inserted into the holes 20, and the first projection 55 of the locking ring 51 is fit into the first recess 15*a*. Thus, the sealing unit 50 is engaged with the female housing 10 in a pre-set condition. Though not illustrated, the second projection 56, the third projection 57 and the fourth projection 58 are fit into the second recess 16*a*, the third recess 17 and the fourth recess 18, respectively, when the first projection 55 is fit into the first recess 15*a*. Thus, the sealing unit 50 is engaged in the recess 11 at a first predetermined position closer to the front of the female housing 10 than a later-mentioned second predetermined position.

Thereafter, as illustrated in FIG. 6, the terminals 30 are inserted into the terminal storage spaces 12. The lance 19 is once pushed up by the lance engagement portion 31 protruding from a sheath portion 32 of the terminal 30, and then, returned to its initial position. Thus, the lance engagement portion 31 is located in front of the lance 19, that is, the lance engagement portion 31 and the lance 19 are engaged with each other in a first engagement condition.

Figure 7:
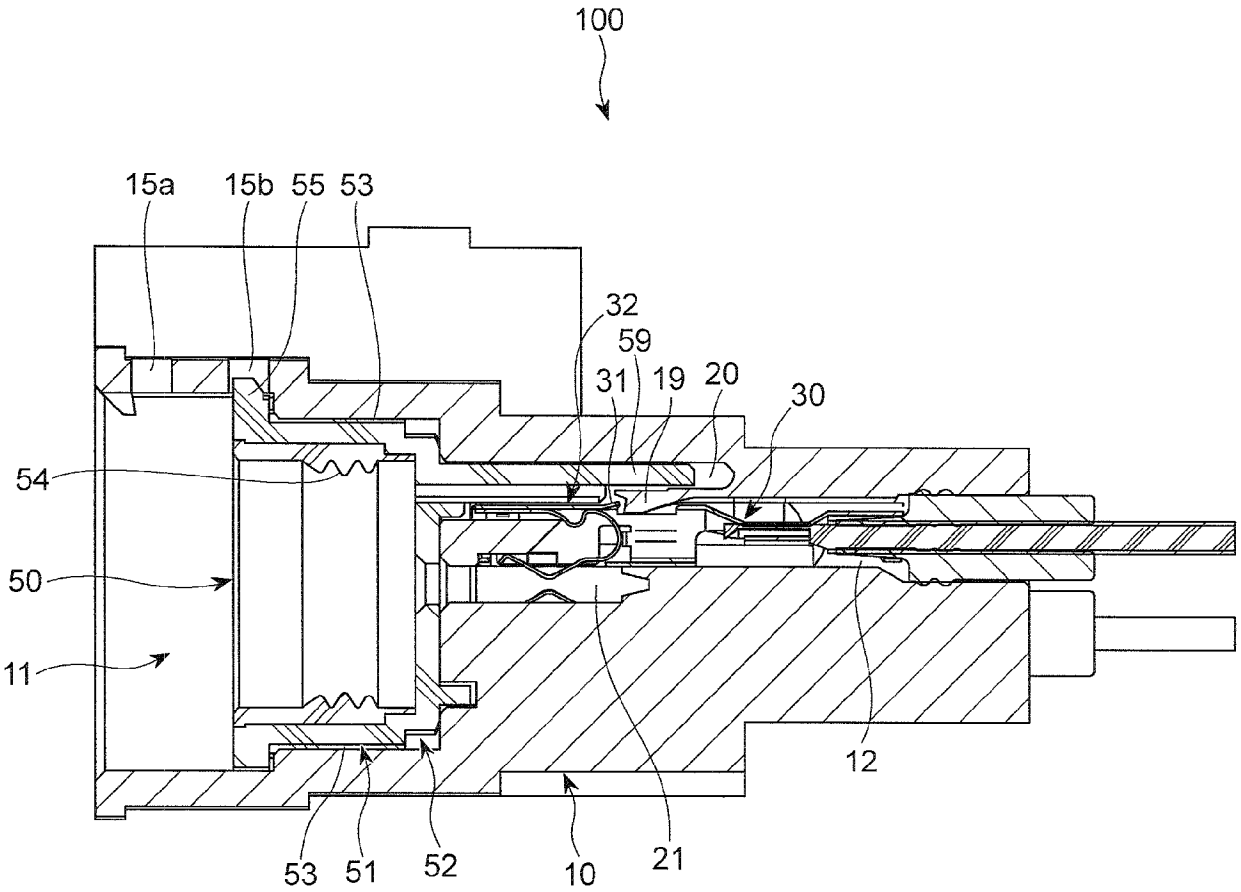
FIG. 7 is a cross-sectional view of the sealing unit, the female housing, and the terminal, wherein the sealing unit is fit into the female housing in a complete-set condition in a process of assembling the waterproof connector in accordance with the first embodiment of the present invention.

Then, as illustrated in FIG. 7, the sealing unit 50 is inserted further into the recess 11. Each of the extensions 59 of the front holder 52 is inserted into each of the holes 20 of the female housing 10, and the first projection 55 of the locking ring 51 is fit into the first recess 15*b* of the female housing 10. Thus, the sealing unit 50 is engaged with the female housing 10 in a complete-set condition. In this situation, though not illustrated, the second projection 56 of the locking ring 51 is fit into the second recess 16*b* of the female housing 10. The third and fourth projections 57 and 58 slide in and along the third and fourth recesses 17 and 18, respectively, in the direction R. Thus, the sealing unit 50 is engaged in the recess 11 at the second predetermined position closer to a rear of the female housing 10 than the above-mentioned first predetermined position.

In the complete-set condition illustrated in FIG. 7, each of the extensions 59 is disposed at a top end thereof in facing relation with the lance 19, preventing the lance 19 from moving away from the terminal 30, that is, upwardly moving. Thus, it is possible to prevent each of the terminals 30 from being released out of the terminal storage space 12.

Figure 8:
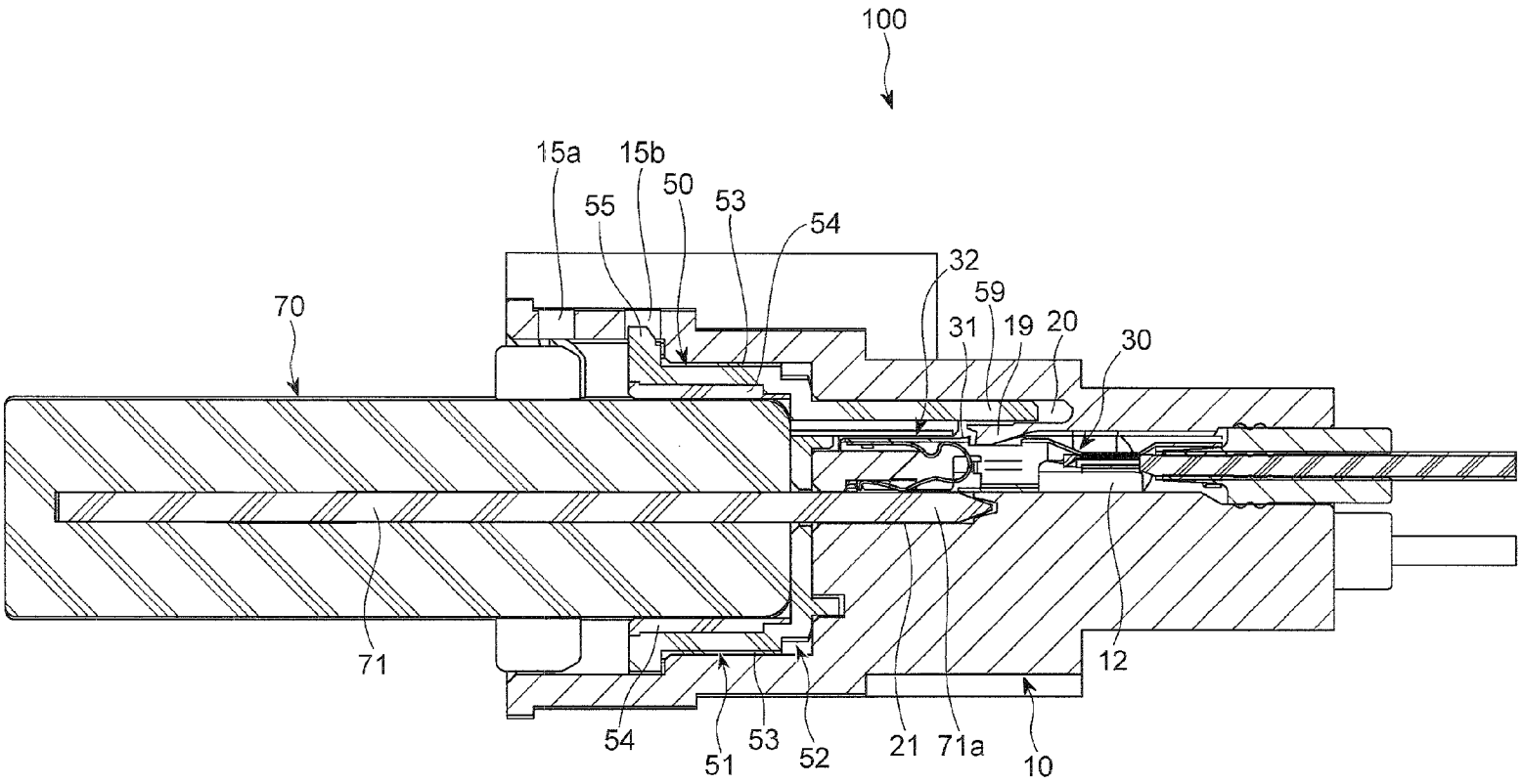
FIG. 8 is a cross-sectional view of the sealing unit, the female housing, the terminal, and a male housing, wherein the male housing is fit into the waterproof connector in accordance with the first embodiment of the present invention.

Then, as illustrated in FIG. 8, the male housing 70 including a sealed circuit board 71 is inserted into the recess 11. Thus, an extended portion 71*a* of the sealed circuit board 71 is inserted a space 21 being open to the recess 11, and hence, an electrically conductive portion (not illustrated) formed at a surface of the extended portion 71*a* makes contact with a part of the terminal 30 exposed in the space 21. Thus, the sealed circuit board 71 and the terminal 30 are electrically connected to each other.

Figure 9:
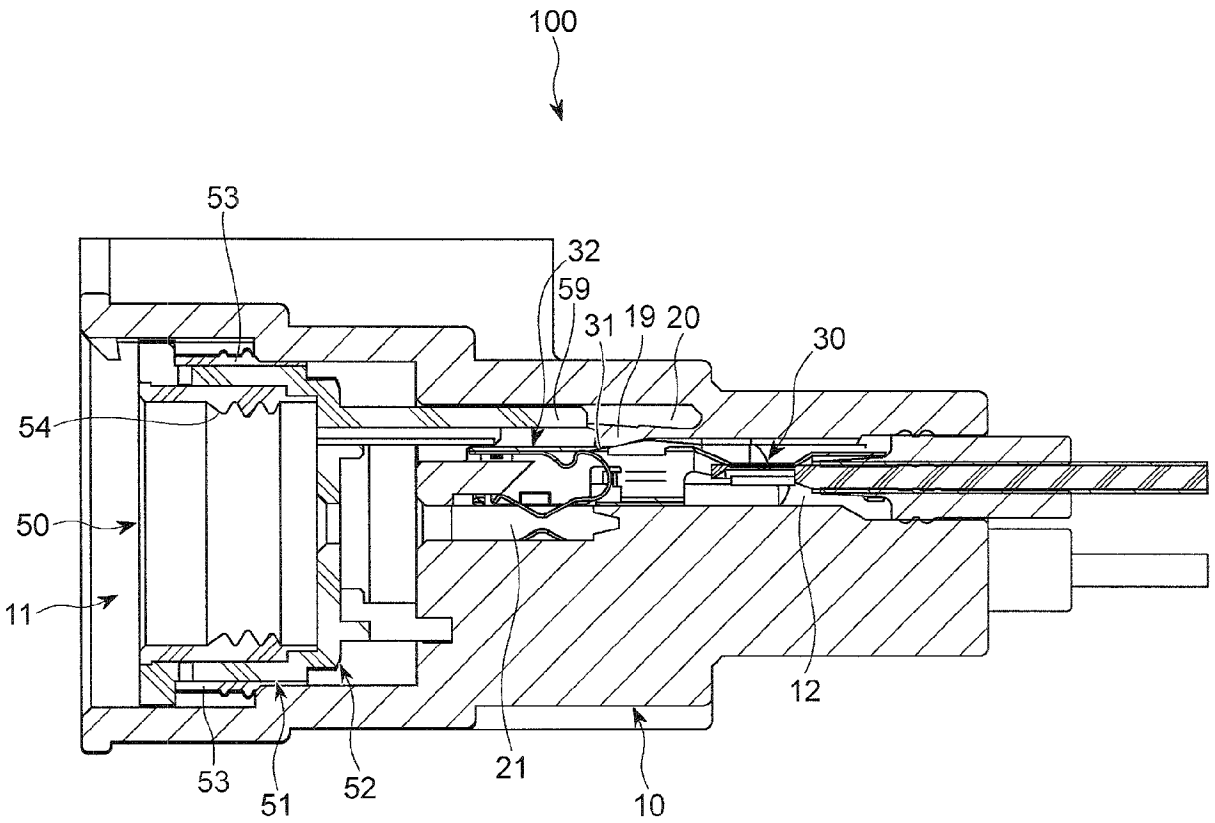
FIG. 9 is a cross-sectional view of the terminal and the waterproof connector in accordance with the first embodiment of the present invention, wherein the terminal is inserted into the waterproof connector in a defective condition in a process of assembling the waterproof connector.

As illustrated in FIG. 9, if any one of the terminals 30 is inserted only half into the terminal storage space 12, that is, if any one of the terminals 30 fails to arrive at a designed position in the terminal storage space 12, the lance 19 is kept lying on a sheath portion 32 of the terminal 30, and hence, the lance 19 is kept partially protruding into the hole 20. If the sealing unit 50 is inserted into the recess 11 in such a condition, the sealing unit 50 cannot be moved forward at a time the extension 59 makes abutment at a top end thereof with the protruded portion of the lance 19. Accordingly, it is possible to detect that the terminal 30 is not correctly inserted into the terminal storage space 12.

That is, in the waterproof connector 100 in accordance with the first embodiment, the extension 59 of the front holder 52 is not allowed to be inserted into the hole 20 when the terminal 30 is inserted into the terminal storage space 12 at a position other than the predetermined position, and, in contrast, the extension 59 is allowed to be inserted into the hole 20 when the terminal 30 is inserted into terminal storage space 12 at the predetermined position. Accordingly, it is possible to detect whether the terminal 30 is correctly inserted into the terminal storage space 12 or whether the terminal 30 is inserted half into the terminal storage space 12.

Similarly to the relation between the extension 59 and the terminal 30, only when the terminal 30 is correctly inserted into the terminal storage space 12, the first and second projections 55 and 56 can be fit into the first and second recesses 15*b* and 16*b*, respectively. Accordingly, the combination of the first and second projections 55 and 56 and the first and second recesses 15*b* and 16*b* can make it possible to detect whether the terminal 30 is correctly inserted into the terminal storage space 12.

In the waterproof connector 100 in accordance with the first embodiment, the sealing unit 50 can be engaged in the recess 11 of the female housing 10 at a predetermined position by means of the locking ring 51. Accordingly, the sealing unit 50 (and accordingly, the waterproof connector 100) is not necessary to include components indispensable for the waterproof connector 200 illustrated in FIGS. 13 to 19, such as the engagement piece 210 having the projection 212, and the recess 211 in which the first and second projections 213 and 214 are formed. Thus, the sealing unit 50, and accordingly, the waterproof connector 100 can be readily fabricated by a resin-molding process.

Furthermore, since the locking ring 51, the front holder 52, and the waterproof seal 53 are integrated with one another as a single piece in the waterproof connector 100 in accordance with the first embodiment, the number of parts for fabricating the sealing unit 50 can be reduced, ensuring improvement in an efficiency with which the sealing unit 50 is assembled.

Additionally, the waterproof seal 53 sandwiched between the outer surface of the locking ring 51 and the inner surface of the recess 11 provides sufficient waterproof performance to the waterproof connector 100.

Second Embodiment

Hereinbelow is explained a waterproof connector in accordance with a second embodiment of the present invention, with reference to FIGS. 10 to 12. As explained hereinbelow in detail, the waterproof connector in accordance with the second embodiment is designed to include a sealing unit 60 in place of the above-mentioned sealing unit 50 in comparison with the waterproof connector 100 in accordance with the first embodiment. Accordingly, parts or elements that correspond to the waterproof connector 100 in accordance with the first embodiment have been provided with the same reference numerals, and operate in the same manner as corresponding parts or elements in the first embodiment, unless explicitly explained hereinbelow.

Figure 10:
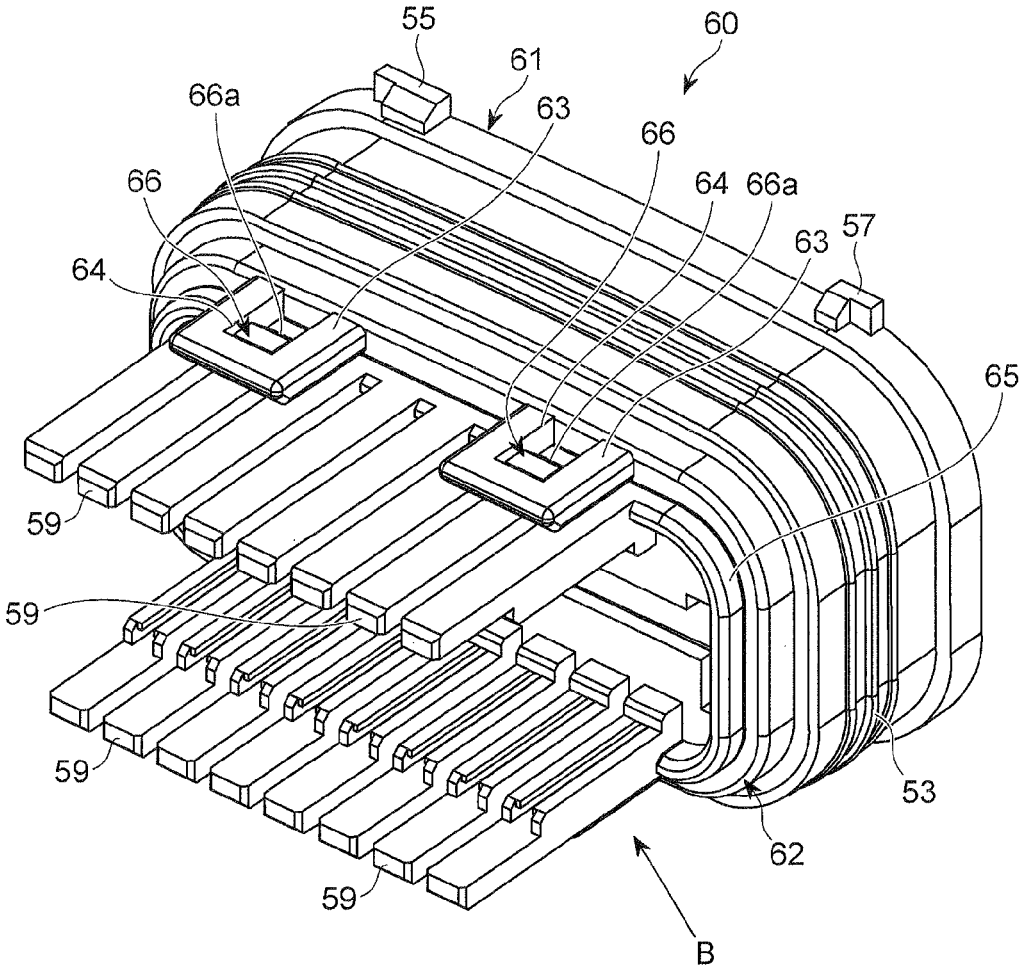
FIG. 10 is a perspective view of the sealing unit as a part of the waterproof connector in accordance with a second embodiment of the present invention.
Figure 11:
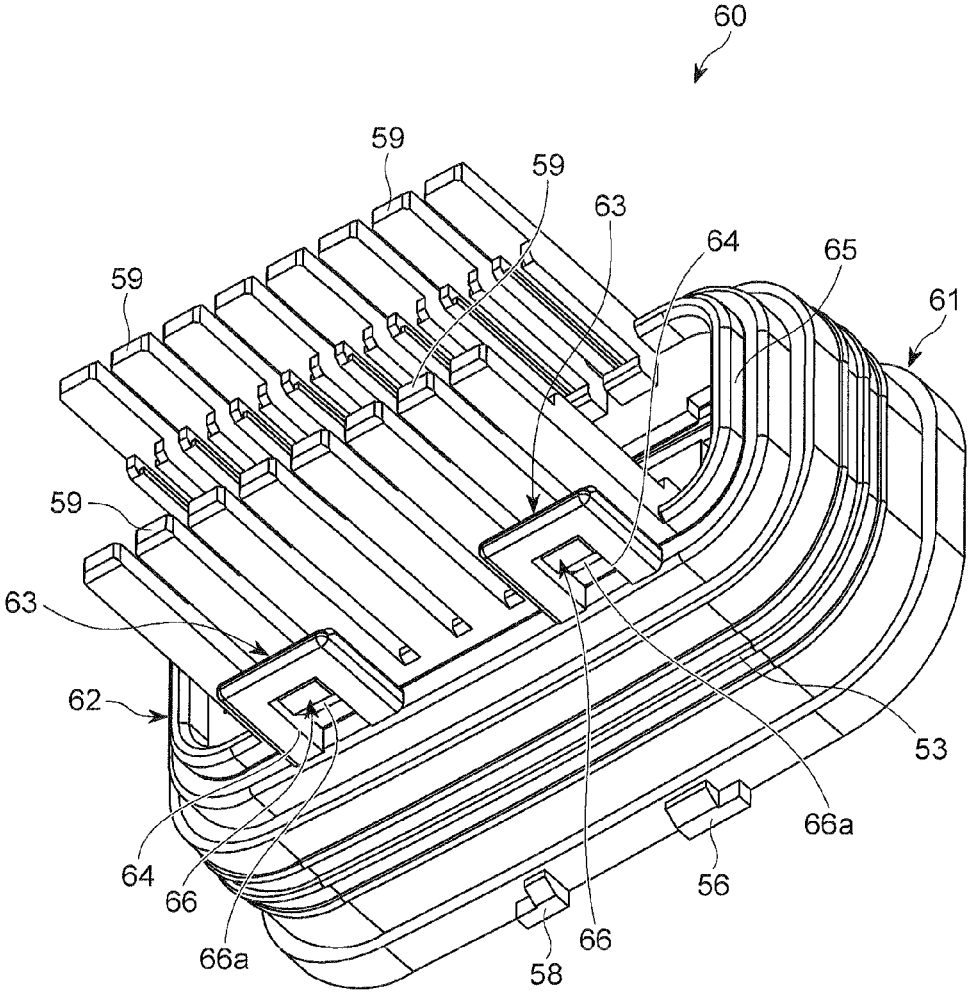
FIG. 11 is a perspective view of the sealing unit as viewed in a direction indicated with an arrow B shown in FIG. 10.

FIGS. 10 and 11 illustrate the sealing unit 60 as a part of the waterproof connector in accordance with the second embodiment.

Figure 12:
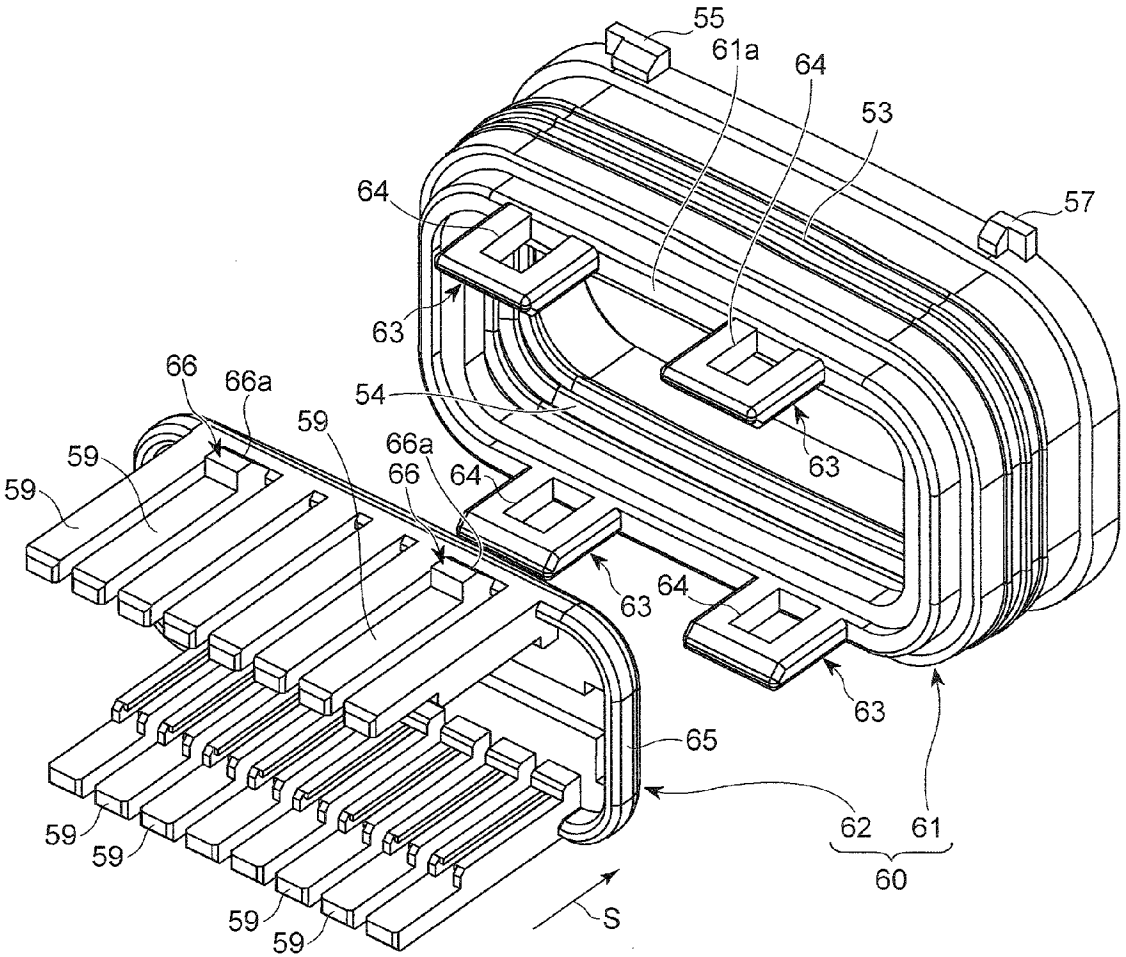
FIG. 12 is a broken perspective view of the sealing unit illustrated in FIGS. 10 and 11.
Figure 13:
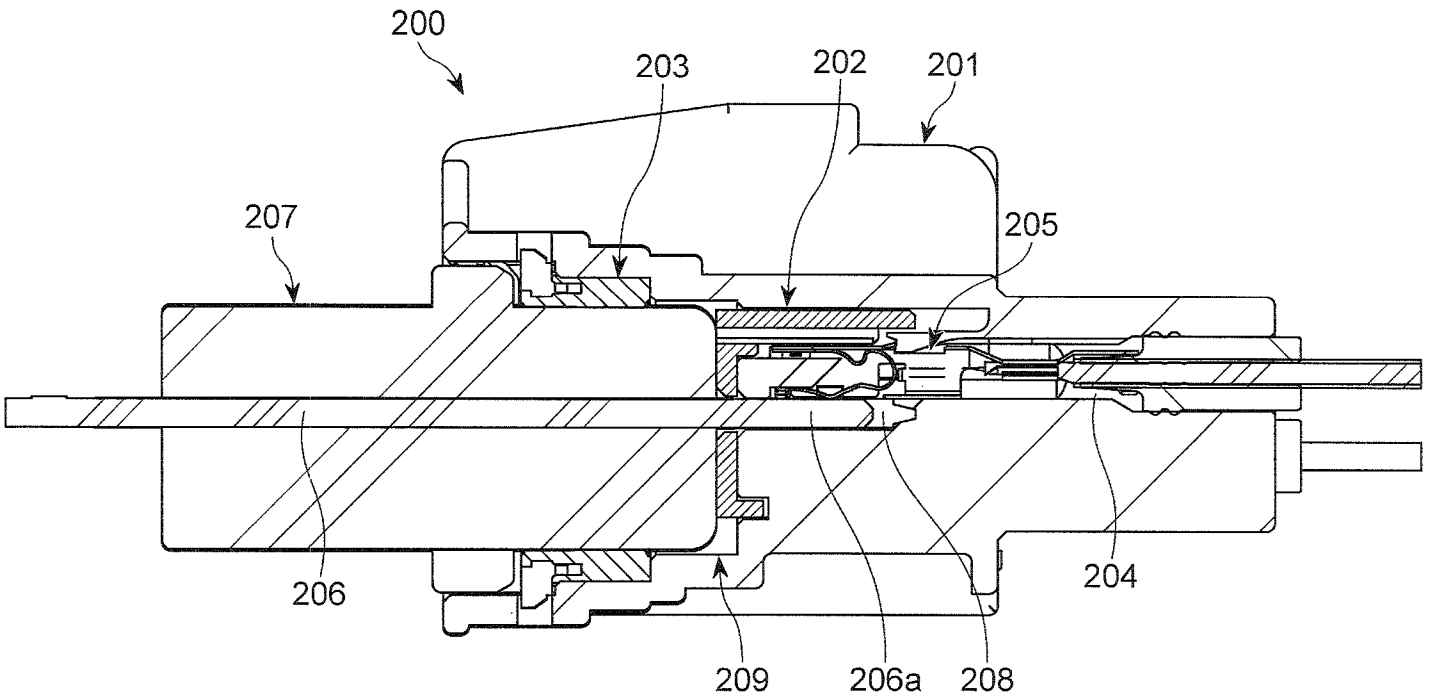
FIG. 13 is a cross-sectional view of a waterproof connector described as an example for better understanding of the present invention.
Figure 14:
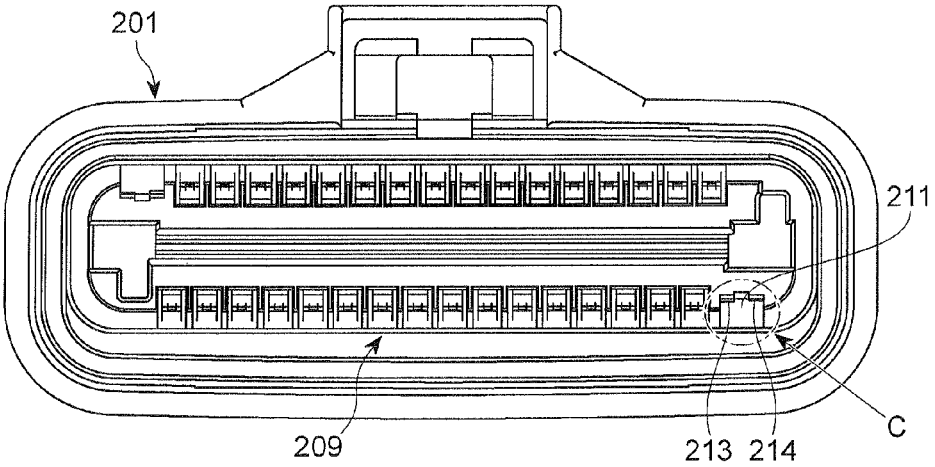
FIG. 14 is a front view of a female housing as a part of the waterproof connector illustrated in FIG. 13.
Figure 15:
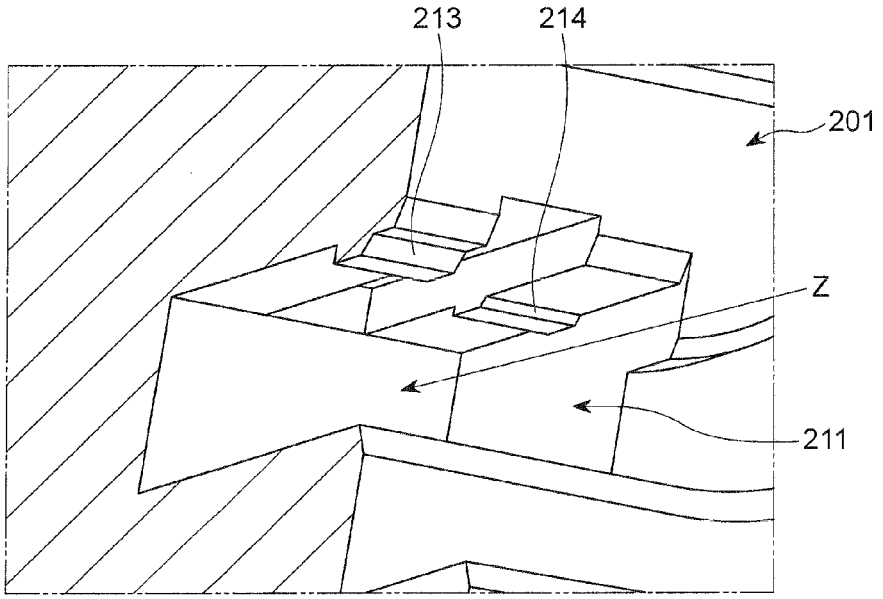
FIG. 15 is a perspective cross-sectional view of a portion indicated with an arrow C shown in FIG. 14.
Figure 16:
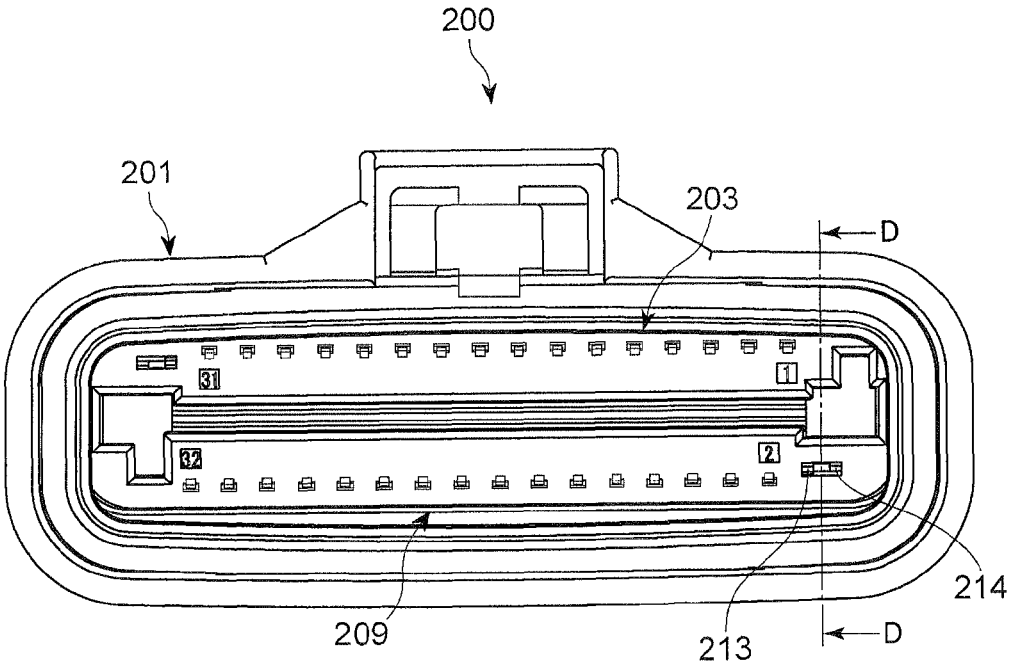
FIG. 16 is a front view of a front seal and a seal holder both being fit in a pre-set condition into the female housing illustrated in FIG. 14.
Figure 17:
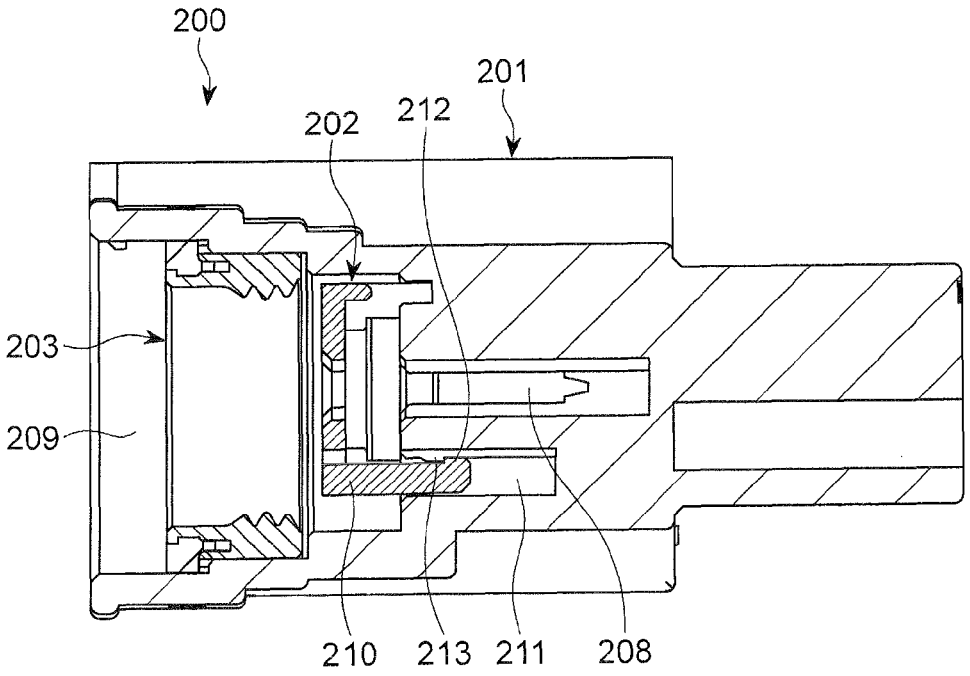
FIG. 17 is a cross-sectional view taken along the line D-D shown in FIG. 16.
Figure 18:
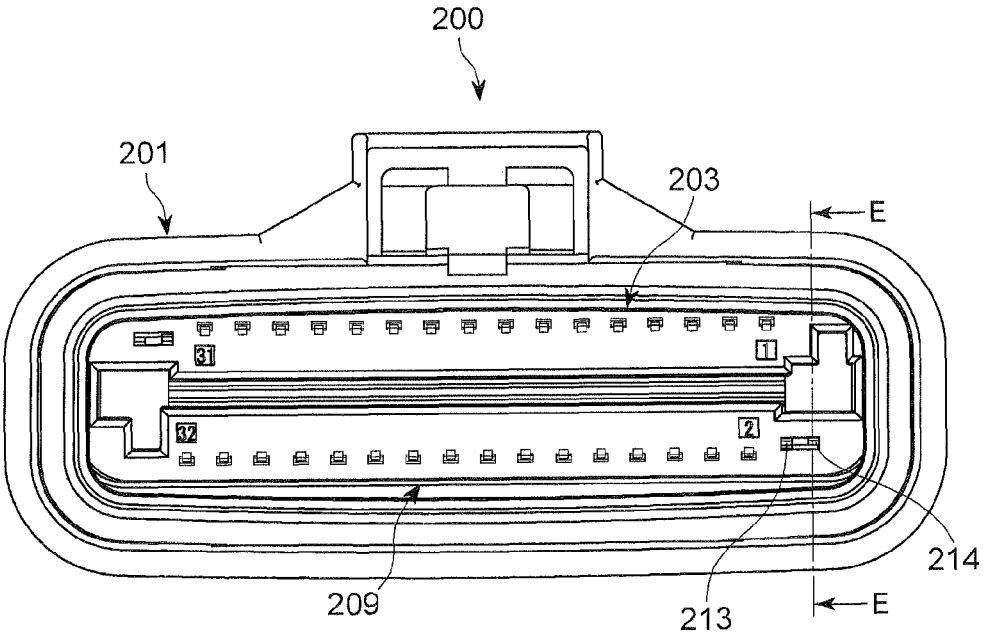
FIG. 18 is a front view of a front seal and a seal holder both being fit in a complete-set condition into the female housing illustrated in FIG. 14.
Figure 19:
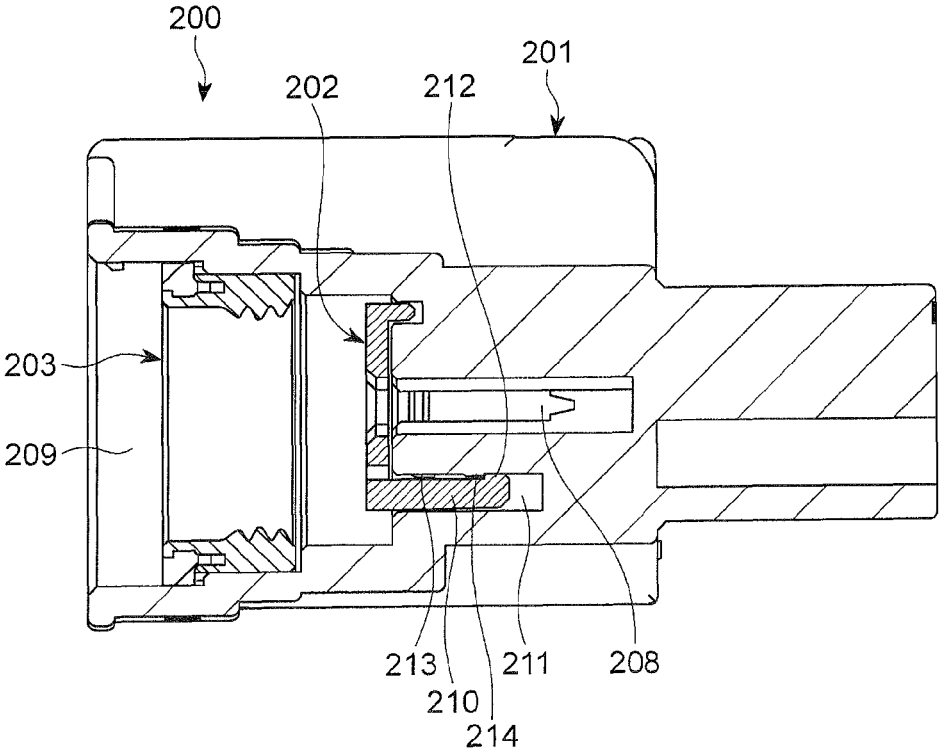
FIG. 19 is a cross-sectional view taken along the line E-E shown in FIG. 18.

As illustrated in FIG. 12, the sealing unit 60 comprises a locking ring 61 and a front holder 62. Each of the locking ring 61 and the front holder 62 is a separate part, and they can be coupled to each other to define the sealing unit 60.

The locking ring 61 has a rectangular cross-section with rounded corners, and includes four extensions 63 horizontally extending from a rear peripheral edge 61*a*. The extensions 63 are located symmetrically with one another with respect to a longitudinal center line of the locking ring 61. Each of the extensions 63 is in the form of a flat plate, and is formed with a vertical through-hole, 64.

The front holder 62 includes an engagement portion 65 having a rectangular cross-section with rounded corners so as to be able to make close contact with the rear peripheral edge 61*a* of the locking ring 61, a plurality of extensions 59 extending from the engagement portion 65 towards a rear thereof, and four engagement projections 66 formed at proximal ends of the extensions 59. The engagement projections 66 are located in alignment with the extensions 63 of the locking ring 61 when the locking ring 61 is coupled with the front holder 62 in a later-mentioned way.

Each of the engagement projections 66 is formed with an inclining surface 66*a* having such an inclination angle that a portion thereof located closer to a distal end of the extension 59 is located remoter from the extension 59. In other words, the inclining surface 66*a* is inclined towards a distal end of the extension 59.

The locking ring 61 and the front holder 62 are coupled to each other as follows.

As illustrated in FIG. 12, the engagement portion 65 of the front holder 62 is caused to face the rear peripheral edge 61*a* of the locking ring 61, and then, the front holder 62 is moved in a direction indicated with an arrow S to thereby exert a force on the engagement portion 65 such that the engagement portion 65 makes contact with the rear peripheral edge 61*a*. Thus, the extensions 63 slide on and along the inclining surfaces 66*a* of the engagement projections 66, and simultaneously, are elastically deformed. Then, the engagement projections 66 are fit into the through-holes 64. Thereafter, the extensions 63 having been elastically deformed elastically return to initial shapes thereof, that is, shapes on which no forces act. Thus, the engagement projections 66 are kept fit into the through-holes 64.

By carrying out the above-mentioned steps, as illustrated in FIGS. 10 and 11, the locking ring 61 and the front holder 62 are coupled to each other to thereby define the sealing unit 60.

The thus assembled sealing unit 60 is incorporated into the female housing 10 to thereby define the waterproof connector in accordance with the second embodiment.

As mentioned earlier, the sealing unit 60 can be fabricated with an improved efficiency relative to the sealing unit 50 in the first embodiment, because a process including steps of fabricating the locking ring 61 and the front holder 62 each as a separate part, and coupling them to each other to thereby define the sealing unit 60 makes it possible to readily fabricate the sealing unit 60 in comparison with the sealing unit 50 in which the locking ring 51 and the front holder 52 are integrated with each other.

The sealing unit 60 provides the same advantages as those provided by the sealing unit 50.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

For instance, the first recesses 15*a* and 15*b*, the second recesses 16*a* and 16*b*, the third recess 17, and the fourth recess 18 may be replaced with through-holes, because the first to fourth projections 55, 56, 57 and 58 can be fit not only into recesses, but also into through-holes.

The number of the first to fourth projections 55, 56, 57 and 58 is not limited to one (1). The first to fourth projections 55, 56, 57 and 58 may be formed by two or greater, in which case, the first to fourth recesses 15*a* to 18 are formed by the same number.

INDUSTRIAL APPLICABILITY

The sealing unit and the waterproof connector both in accordance with the present invention can be broadly employed in various industrial fields such as an electronic/electric device industry and an automobile industry.

The entire disclosure of Japanese Patent Application No. 2014-156763 filed on Jul. 31, 2014 including specification, claims, drawings and summary is incorporated herein by reference in its entirety.

What is claimed is:

1. A waterproof connector including a first housing formed with a recess, and a sealing unit to be sandwiched between said first housing and a second housing fit into said recess, to thereby keep waterproofness between said first and second housings, said sealing unit including:

an locking ring for causing said sealing unit to engage said recess at a predetermined position;

a holder for preventing a terminal having been inserted into said first housing from being released out of said first housing; and a waterproof seal sandwiched between an outer surface of said locking ring and an inner surface of said recess, said locking ring, said holder, and said waterproof seal being integrated with one another.

2. The waterproof connector as set forth in claim 1, further including at least one projection projecting from said locking ring, and a plurality of recesses being open to an inner surface of said recess, said projection being fittable into said recesses.

3. The waterproof connector as set forth in claim 1, wherein said locking ring includes a first side edge, and a second side edge spaced away from said first side edge and facing said first side edge, said sealing unit further including a first projection and a second projection, said first projection being formed on said first side edge, and outwardly extending from an outer surface of said locking ring in a direction perpendicularly to a length-wise direction of said sealing unit, said second projection being formed on said second side edge, and outwardly extending from an outer surface of said locking ring in a direction perpendicularly to a length-wise direction of said sealing unit, said first housing being formed with at least two first recesses or first through-holes into which said first projection is fit, and at least two second recesses or second through-holes into which said second projection is fit, said first recesses or first through-holes being spaced apart from each other in a direction in which said second housing is inserted into said recess, said second recesses or second through-holes being spaced apart from each other in a direction in which said second housing is inserted into said recess, a pitch between said first recesses or first through-holes being equal to a pitch between said second recesses or second through-holes.

4. The waterproof connector as set forth in claim 3, wherein said first projection and said second projection are situated in a diagonal line of said locking ring.

5. The waterproof connector as set forth in claim 3, wherein said locking ring further includes:

a third projection standing on said first side edge and being spaced apart from said first projection, said third projection outwardly extending from an outer surface of said locking ring in a direction perpendicularly to a length-wise direction of said sealing unit; and a fourth projection standing on said second side edge and being spaced apart from said second projection, said fourth projection outwardly extending from an outer surface of said locking ring in a direction perpendicularly to a length-wise direction of said sealing unit.

6. The waterproof connector as set forth in claim 5, wherein said first and third projections are situated on said first side edge symmetrically about the center of said locking ring, and said second and fourth projections are situated on said second side edge symmetrically about the center of said locking ring, one of a distance between said first and third projections and a distance between said second and fourth projections being greater than the other.

7. The waterproof connector as set forth in claim 3, wherein said first and second projections are situated closer to the front of said locking ring than said waterproof seal.

8. The waterproof connector as set forth in claim 1, wherein said holder includes at least one extension insertable into a hole extending from said recess such that a posture of a lance engaged with said terminal having been inserted into said first housing is kept uniform.

9. The waterproof connector as set forth in claim 1, wherein each of said locking ring and said holder is a separate part, and said locking ring and said holder can be coupled to each other.

10. The waterproof connector as set forth in claim 9, wherein said locking ring includes at least one extension horizontally extending from a front edge thereof, said extension being formed with a vertical through-hole, said holder including a projection to be fit into said vertical through-hole when said locking ring and said holder are coupled to each other.

* * * * *